United States Patent [19]

Goldfarb et al.

[11] 4,164,092

[45] Aug. 14, 1979

[54] TOY MILKABLE ANIMAL FIGURE

[75] Inventors: Adolph E. Goldfarb, 4614 Monarca Dr., Tarzana, Calif. 91356; Erwin Benkoe, deceased, late of Encino, Calif., by Elisabeth Benkoe, executrix; Elonne Dantzer, Hermosa Beach, Calif.

[73] Assignee: A. E. Goldfarb, Northridge, Calif.

[21] Appl. No.: 772,012

[22] Filed: Feb. 25, 1977

[51] Int. Cl.[2] ..... A63H 13/02

[52] U.S. Cl. ..... 46/123; 46/141; 222/78

[58] Field of Search ..... 46/123, 141, 44; 222/78

[56] References Cited

U.S. PATENT DOCUMENTS

| | | | |
|---|---|---|---|
| 2,536,518 | 1/1951 | Shrier | 222/78 |
| 2,577,849 | 11/1951 | Henry | 222/78 |
| 2,619,257 | 11/1952 | Posner | 222/78 |
| 2,643,033 | 6/1953 | Miscione | 272/78 X |
| 2,648,162 | 8/1953 | Moeller | 46/141 |
| 2,705,090 | 3/1955 | Odermett-Wehrli | 46/123 X |
| 2,912,791 | 11/1959 | Cohen | 46/44 X |
| 4,087,933 | 5/1978 | Strongin | 46/44 |

*Primary Examiner*—Louis G. Mancene

*Attorney, Agent, or Firm*—Robert M. Ashen; Robert J. Schaap

[57] ABSTRACT

A toy milkable animal figure such as a cow which includes a chamber for liquid, an inlet to the chamber, and an outlet from the chamber. The chamber defines a flexible udder having at least one teat with an openable aperture. The aperture comprises the outlet. The udder may be manually manipulated by a child-user as by squeezing to cause release of the liquid through the aperture. The animal figure may include a pump which may be manually operable, as for example, by pumping the tail, and the inlet to the chamber may be connected by an inlet tube to the mouth of the animal which may be immersable in a source of water. The pump may include an overflow system which permits water to be pumped through a return tube in the figure and back to the source of water when the chamber is filled. The chamber may be openable for cleaning and also to permit introduction into the chamber of a dye or pigment which will color water in the chamber white so that it has the appearance of milk when it is discharged through the udder aperture. In this way, a child playing with the animal figure can observe the cow drinking water and ostensibly convert the water into milk which can be released from the udder.

19 Claims, 3 Drawing Figures

TOY MILKABLE ANIMAL FIGURE

Applicants are not aware of any comparable devices in the prior art. There have been toy animal figures which housed a flexible liquid holding bulb that was connected to a rigid udder simulating portion of the figure. When the bulb was compressed, liquid would flow out of the udder. There also have been dolls with the capability of receiving and holding water which was released when the doll was positioned on a toilet seat. There have been other dolls which received water which flowed directly through the doll into a diaper. There have also been novelty figures where a liquid-holding bulb was attached by means of a tube to the doll in such a manner that discharge of liquid from the bulb through the tube created the apperance of the figure urinating.

The present invention contemplates the provision of a play toy animal figure which permits the child-user to milk the animal figure in simulation of such real activity by squeezing a flexible udder. In one form, a toy cow depicting figure is operable to drink water and to then be milked by squeezing its udder to cause the discharge of a white-colored milk-simulating liquid. This device has both substantial play value as well as educational value for children.

IN THE DRAWINGS

Figure 1:
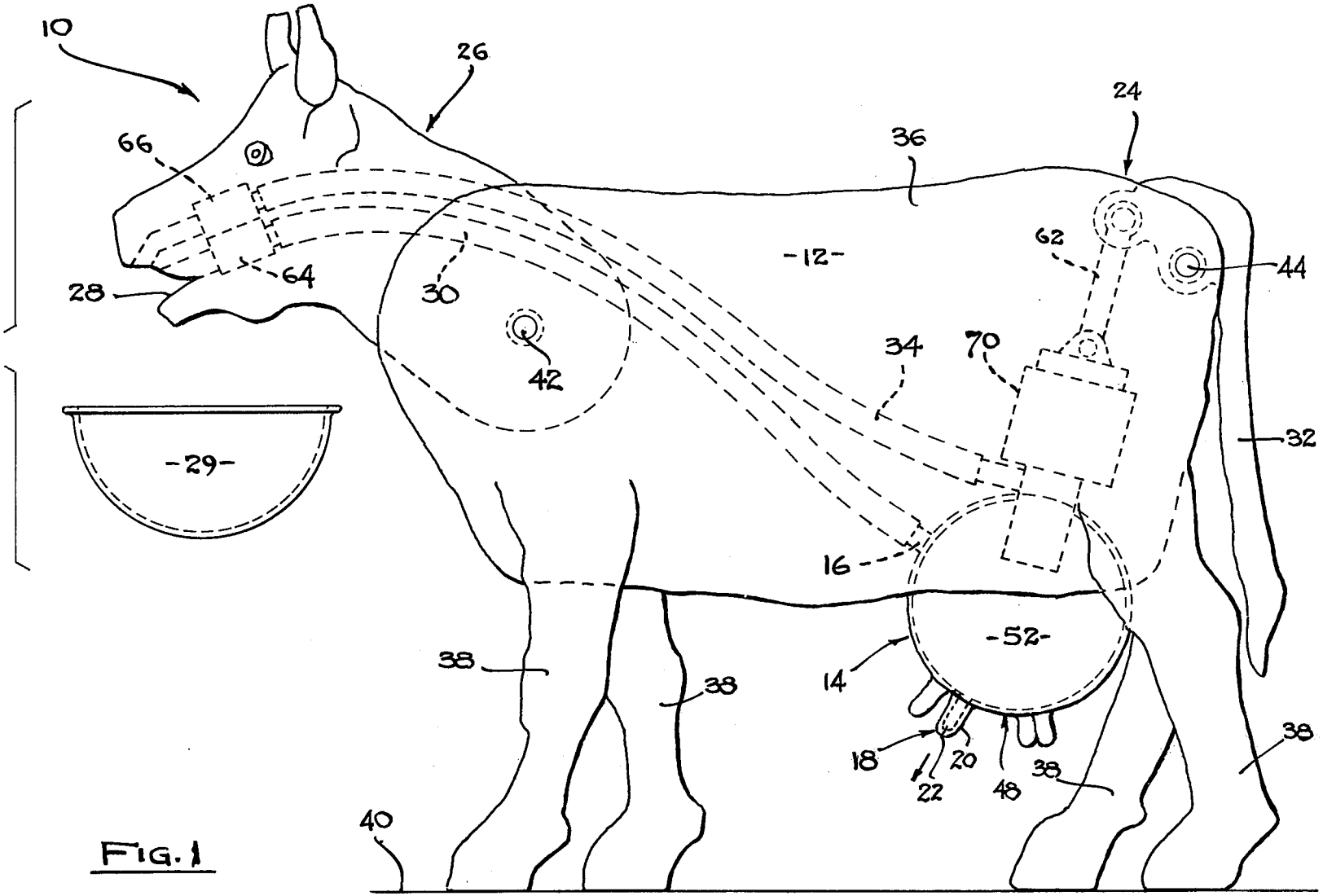
FIG. 1 is a side elevational view of a presently preferred form of the invention in the form of a toy milkable cow figure.
Figure 3:
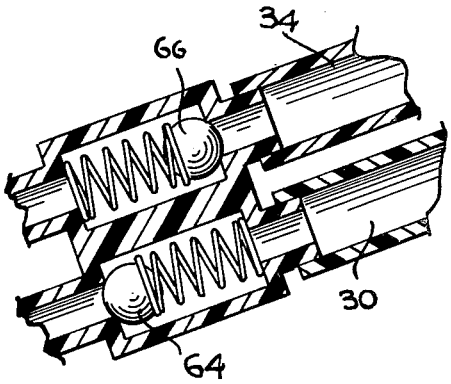
FIG. 3 is a side sectional view of a pair of valves comprising a portion of the pump for the toy figure of FIGS. 1 and 2.

Briefly, the illustrated toy milkable animal figure 10 comprises a body or frame 12 on which is supported a liquid storage chamber 14 having an inlet 16 and an outlet 18. The chamber 14 represents an udder and the outlet 18 represents a teat 20 having an openable aperture 22. The udder can be manipulated as by squeezing by a child-user to cause discharge of milk-appearing liquid from the chamber 14 through the aperture 22. The illustrated toy figure 10 includes a pump mechanism 24 for drawing water into the chamber. In the illustrated animal figure, the head 26 of the cow is pivoted so it may have its mouth 28 immersed in a source of water 29 and an inlet line or conduit 30 leads from the mouth to the storage chamber 14. In the illustrated form, the pump mechanisn 24 is operated by pumping the pivotally mounted tail 32 of the cow. The pump mechanism 24 includes an over-flow or return line or conduit 34 leading back to the mouth 28 of the cow figure. The chamber 14 is openable so that it can be cleaned and also so that a suitable dye or pigment can be placed in the chamber to color the water received in the chamber white to give it the appearance of milk when it is discharged.

Now to describe the illustrated toy milkable animal figure 10 in further detail. The body or frame 12 comprises a main or torso section 36 which extends generally horizontally and is hollow. Four upstanding legs 38 are integrally connected to the torso section 36 so that the cow figure will stand upright on a supporting surface 40, such as a table or the floor. The cow's head 26 is pivotally mounted to the forward end of the torso portion 36 for pivotal movement about a generally transverse horizontal axis 42. The head 26 has the mouth opening 28 at its forward end. It is also a generally hollow structure. The elongated tail 32 is pivotally mounted at the rear end of the torso section 36 for pivotal movement about a generally transverse horizontal axis 44. The foregoing portions combine to provide the appearance of a cow.

Other animal figures may be depicted such as a goat or a deer as desired. The foregoing portions may be constructed of any suitable material, such as, for example, molded plastic.

Figure 2:
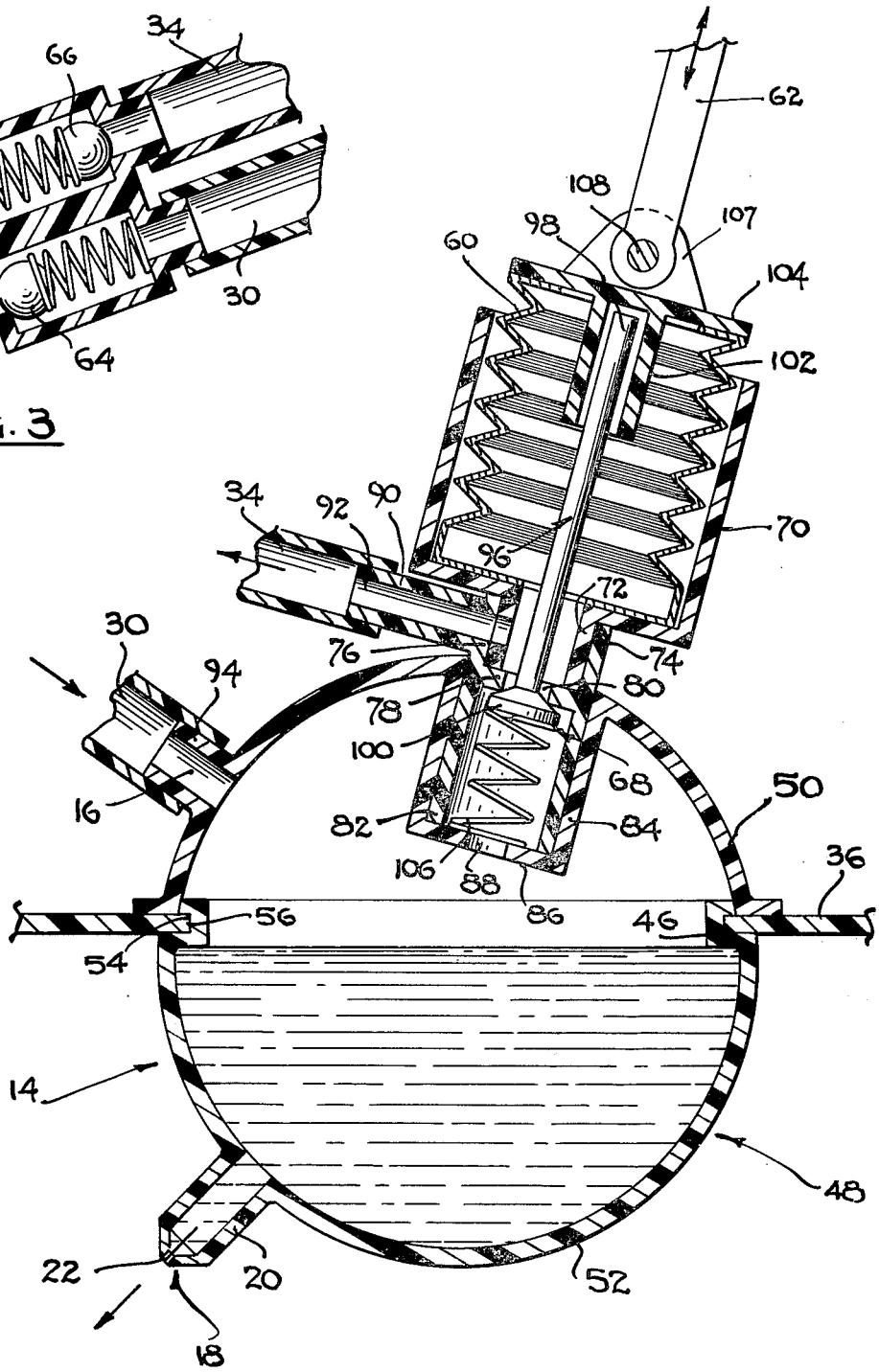
FIG. 2 is an enlarged side sectional view of the storage chamber and a portion of the pump of the toy figure of FIG. 1.

As shown best in FIG. 2, a downwardly facing opening 46 is provided toward the rear of the torso portion for support of a generally spherical chamber or udder forming means 48. This chamber forming means may be one integral part but it is preferably comprised of a plurality of parts which are inter-connected to form an enclosed chamber for receiving and retaining liquid. The illustrated chamber forming means 48 comprises an upper half 50 fixedly secured to and located within the torso portion 36 and a lower half 52 releasibly supported on the peripheral edge of the opening 46 and having the appearance of the udder of the cow. The lower half 52 has its upper edge turned inwardly and then outwardly to form an outwardly facing circumferential groove 54 which is releasably engageable with the peripheral lip 56 of the opening 46. The lower half 52 is of a somewhat flexible, resilient material so that it may be attached and removed from such supporting engagement with the lip 56. In this manner, the lower half 52 can be removed to clean the interior of the chamber and for insertion into the chamber of the dye or pigment to color the "milk". The illustrated udder or lower half 52 may include a plurality of the outwardly extending integrally formed teats 20 as shown in FIG. 1. The lower half 52 which provides the udder and teats may be a unitary molded plastic part of a flexible, resilient material. As shown best in FIG. 2, one of the teats 20 has a small aperture or opening 22 which may take the form of a small slit. Preferably, the opening 22 normally assumes a closed position to retain liquid in the chamber, while it is capable of being opened by manipulation or squeezing of the udder by the child-user to permit discharge of "milk" from the teat aperture 22. Thus, there is provided in effect a closable valve which is opened by squeezing or manipulation of the udder. While some small amount of leakage would be permissable, it is preferred that no liquid be discharged from the udder when it is not being squeezed or manipulated and that it be capable of discharging a significant amount of liquid when it is squeezed or manipulated.

In a preferred form, the teat portion of the udder is about one half an inch long so that it may be grasped near its upper end by the child and squeezed to produce a discharge or flow of "milk" out of the aperture 22. When the teat 20 is thus grasped and squeezed, the teat itself is generally closed off from the chamber and the liquid thus trapped in the teat is discharged through the aperture. This creates a realistic simulation of milking the cow. Alternatively, the entire udder may be squeezed to provide the milking.

Constructing the udder of a flexible material not only provides for the operation noted above, but also provides realistic simulation of the feel of an udder of a real animal.

The pump mechanism 24 is supported on and within the animal figure body or frame. This mechanism 24 comprises generally a collapsible bellows unit 60, which is biased to an expanded position and is in communication with the interior of the chamber 14. The bellows 60 is connected, through a mechanical link 62, to the pump handle which in the illustrated toy is comprised by the cow'tail 32. The pump mechanism further includes the intake conduit 30 which leads from the cow's mouth opening 28 to the inlet 16 to the chamber 14. There is a one-way flow valve 64 at the forward end of the conduit 30 which permits flow into the chamber 14 but not in the opposite direction. The pump mechanism 24 still further includes the return conduit 34 from the chamber to the cow's mouth opening 28. There is a second one-way flow valve 66 at the forward end of conduit 34 which permits flow from the chamber but not into it. The return conduit 34 serves to carry over-flow liquid from the chamber 14 back to the liquid source of reservoir 29 from which the animal drinks. It also serves as the outlet line for the pump mechanism for the discharge of air displaced as liquid is pumped into the chamber. A valve 68 is also provided to close off the return conduit 34 when the tail is lowered so that squeezing the udder 20 will cause "milk" to flow out of it rather than back through conduit 34.

Thus, when the tail 32 is raised and the bellows 60 compressed, the valve 68 is opened and air is evacuated out of the chamber 14 through the conduit 34 and the valve 66. Then the tail is lowered and the bellows expanded, (the cow's mouth 28 being immersed in the liquid source 29) the valve 68 closes and liquid from the source 29 is drawn into the chamber 14 through inlet conduit 30 and valve 64. The tail is raised and lowered until the chamber 14 is filled with liquid. Once the chamber 14 is full, added pumping merely causes the excess liquid to circulate back through conduit 34 to the source.

More particularly, as shown in FIG. 2, the lower end of the bellows 60 is received in and supported by a generally cylindrical pump holder 70 which in turn is mounted on the upper chamber half 50. The holder 70 has a tubular stub portion 72 at its lower end that is received and held in the upper end 74 of an intermediate part 76.

The intermediate part 76 has a transverse wall 78 disposed just below the tubular stub portion 72 and having a central opening 80 which defines the seat for the valve 68. The intermediate part 76 then extends downwardly in a generally tubular end portion 82 which is received in a mating generally cylindrical receptacle portion 84 of the upper chamber half 50. The lower end of portion 82 is open and the receptacle portion 84 has a transverse bottom wall 86 having a central opening 88. Thus, the interior of the bellows 60 is in communication through the stub portion 72, the valve opening 80, the lower end portion 82, and the opening 88 with the interior of the chamber 14. The intermedite part 70 also has a tubular sidewardly extending portion 90 which communicates through an opening 92 in the side wall of the tubular stub portion 72 to the interior of that portion 72. The rear end of the return conduit 34 is secured on the outer end of the sideward extending tubular portion 90. The chamber upper half 50 is also provided with an outwardly extending tubular portion 94 that communicates with the interior of the chamber and on which the rear end of the inlet line or conduit 30 is secured. Portion 94 defines inlet 16.

As also shown in FIG. 2, the valve 68 is comprised by the valve opening 80 and by a valve member 96 which comprises a stem portion 98 and an enlarged valve head 100. The head 100 is disposed in the tubular lower end portion 82 while the stem portion extends upwardly through the opening 80, through the tubular stub portion 72, through the interior of the bellows 60 and into a tubular receptacle portion 102 extending downwardly from a plate section 104 that is secured to the upper end of the bellows. A spring 106 is disposed in the lower tubular end portion 82 between the lower surface of the enlarged valve head 100 and the transverse wall 86. This spring 106 urges the valve head 100 upwardly to tend to seat it in the valve opening 80 and thereby close the valve, as shown in FIG. 2. When the bellows is compressed, the plate 104 bears against the upper end of the valve stem 98 urging the valve member 96 downwardly against the force of the spring 106 and thereby opening the valve 68. The upper end of the bellows 60 is connected to the pump link 62 through the plate section 104 and an upwardly extending tab 107 secured to the plate section 104 and pivotally connected as at 108 to the lower end of the pump link 62.

Thus, when the child-user desires to have the toy cow drink water, he lowers its head and mouth into the reservoir 29 and pumps the tail 32. This serves to draw liquid through the mouth opening 28 into the chamber 14. As noted above, when the tail 32 is raised, the bellows 60 is compressed which evacuates air from the system (including the interior of the bellows) and the interior of the chamber through the conduit 34 since the one-way valve 64 prevents flow in the forward direction through the inlet conduit 30. The valve 68 is physically opened by the downward compression movement of the bellows as noted above to permit this evacuating flow of air from the chamber out the outlet conduit 34. When the tail 32 is pivoted back downwardly to expand the bellows 60, there is internal suction created in the chamber 14 and liquid is drawn through inlet conduit 30 through the one-way valve 64 while flow in that direction is blocked by the one-way valve 66 at the other conduit 34. When there has been sufficient of this pumping to fill the chamber with liquid, any additional pumping will merely recirculate the excess fluid back out through the conduit 34. When the child-user finishes thus pumping the tail to cause the cow to drink, the tail is left in a downward position. This permits the spring 106 to close the valve 68 which closes off the chamber 14 from the return conduit 34. Thus, when the udder is squeezed to "milk" the cow, the liquid from the chamber will be dispensed through the teat aperture 22.

Dye or pigment which will color water white or "milky" and is in any suitable form, such as a tablet, a quantity of powder, or quantity of lquid, may be placed into the chamber 14 at desired intervals so that when water is pumped into the chamber it will mix with the dye or pigment and thereby be colored white. The powder or liquid dye or pigment may be contained in a meltable container. The powder may be contained in a tea-bag type container. then, when the cow is "milked", the water will be discharged in a white or milk-colored form to simulate the appearance of real milk and add to the play value of the toy. Thus, the cow drinks clear water and gives white colored "milk".

Various changes and modifications may be made to the illustrated structure without departing from the spirit and scope of the preset invention as set forth in the appended claims. For example, alternative forms of pumping means or overflow means, may be utilized. Further, in lieu of overflow means, the device may be constructed to control or limit the amount of liquid pumped to the chamber; this may be done for example by having the head automatically raise out of the liquid supply ater a predetermined amount of pumping, or by having the pumping mechanism otherwise become inoperative after a predetermined amount of pumping or after the liquid reaches a predetermined level in the chamber.

Having thus described our invention, what we desire to claim and secure by Letters Patent is:

1. A toy milkable animal figure comprising:
(a) a frame representative of an animal figure,
(b) a chamber for liquid supported on said frame and representing the udder of the animal,
(c) means on said frame connected to and defining an inlet to said chamber for the introduction of liquid into said chamber,
(d) means on said frame connected to and defining an outlet from said chamber, said outlet means defining an openable aperture,
said udder being flexible and manually squeezable to cause the release of liquid through said aperture,
(e) and means providing a coloring agent in said chamber for changing the color of clear liquid such as water introduced into said chamber to a milky color.

2. A toy milkable animal figure comprising:
(a) a frame representative of an animal figure,
(b) a chamber for liquid supported on said frame and representing the udder of the animal,
(c) means on said frame connected to and defining an inlet to said chamber for the introduction of liquid into said chamber,
(d) means on said frame connected to and defining an outlet from said chamber, said outlet means defining an openable aperture,
said udder being flexible and manually squeezable to cause the release of liquid through said aperture,
said chamber being openable to provide access to the interior thereof and reclosable to provide a liquid holding chamber,
(e) and a body of white colored dye or pigment to be disposed within the chamber to color water or other liquid introduced into the chamber a white color simulating the appearance of milk.

3. The toy milkable animal figure of claim 2 wherein said body of material is in tablet form.

4. The toy milkable animal figure of claim 2 wherein said body of material is disposed within an outer container, at least a portion of said container permitting the passage of liquid therethrough.

5. The toy animal apparatus of claim 2 wherein said chamber is readily openable to provide full access to the interior of said udder and reclosable to provide a liquid holding chamber.

6. A liquid drinking and discharging toy animal apparatus, said apparatus comprising:
(a) a body having front and rear ends and a shape and design to characterize an animal;
(b) a head mounted at the front end of said body and having a mouth opening for the intake of a liquid;
(c) a liquid receiving chamber supported at the rear end of said body and having a portion extending outwardly from said body, said portion being representative of an udder of said animal and being flexible and manually squeezable to discharge liquid from said chamber through an openable aperture therein, said chamber being readily openable by the user so that substantially the full cross-sectional area of the interior of the chamber is accessable to view to provide full access to the interior of said udder and reclosable to provide a liquid holding chamber for introduction of material into the chamber and for permitting cleaning of the interior of the udder;
(d) an inlet tube extending from said mouth opening to said chamber for introducing liquid into said chamber;
(e) and pumping means operatively connected to said chamber for pumping liquid through said mouth opening and inlet tube into said chamber.

7. The toy animal apparatus as called for in claim 6 further including means for preventing flow of liquid from said chamber through said inlet tube when said udder is squeezed.

8. A liquid drinking and discharging toy animal apparatus, said apparatus comprising:
(a) a body having front and rear ends and a shape and design to characterize an animal;
(b) a head mounted at the front end of said body and having a mouth opening for the intake of a liquid;
(c) a liquid receiving chamber supported at the rear end of said body and having a portion extending outwardly from said body, said portion being representative of an udder of said animal and being flexible and manually squeezable to discharge liquid from said chamber through an openable aperture therein;
(d) an inlet tube extending from said mouth opening to said chamber for introducing liquid into said chamber;
(e) pumping means operatively connected to said chamber for pumping liquid through said mouth opening and inlet tube into said chamber;
(f) and means for preventing flow of liquid from said chamber through said inlet tube when said udder is squeezed;
said pumping means including an outlet tube extending from said chamber to said mouth opening.

9. The toy animal apparatus of claim 8 wherein said outlet tube includes a one-way flow valve limiting flow to said chamber and said inlet tube includes a one-way flow valve limiting flow away from said chamber.

10. The toy animal appartus of claim 9 further including means for stopping outward flow through said outlet tube on a selective basis to permit flow of liquid from the udder when it is squeezed rather than back through the outlet tube.

11. A A liquid drinking and discharging toy animal apparatus, said apparatus comprising:
(a) a body having front and rear ends and a shape and design to characterize an animal;
(b) a head mounted at the front end of said body and having a mouth opening for the intake of a liquid;
(c) a liquid receiving chamber supported at the rear end of said body and having a portion extending outwardly from said body, said portion being representative of an udder of said animal and being flexible and manually squeezable to discharge liquid from said chamger through an openable aperture therein;
(d) an inlet tube extending from said mouth opening to said chamber for introducing liquid into said chamber;

(e) and pumping means operatively connected to said chamber for pumping liquid through said mouth opening and inlet tube into said chamber, said pumping means including a manually reciprocable member for operating said pumping means to pump liquid into said chamber.

12. The toy animal apparatus of claim 11 wherein said pumping means comprises an expandable and contractable pumping chamber.

13. The toy animal apparatus of claim 11, wherein said head is pivotally mounted on said body for lowering said mouth opening into a supply of liquid.

14. The toy animal apparatus of claim 11 wherein said reciprocable member comprises a tail pivotally mounted at the rear of said body.

15. The toy animal apparatus of claim 11 wherein said udder portion is made of a flexible, resilient material releasably attached to the remainder of said chamber for forming said liquid containing chamber.

16. The animal figure of claim 11 wherein said udder includes an integrally formed flexible and resilient elongate teat having an outer end, said openable aperture being located at said outer end, and said teat being at least about one half inch in length to permit the teat to be grasped by the user a substantial enough distance away from the aperture to trap a substantial quantity of dischargeable liquid in the teat for discharge through the aperture.

17. The animal figure of claim 11 further including overflow means to permit excess liquid pumped into the chamber to be discharged therefrom.

18. A liquid drinking and discharging toy animal apparatus, said apparatus comprising:

(a) a body having front and rear ends and a shape and design to characterize an animal;

(b) a head mounted at the front end of said body and having a mouth opening for the intake of a liquid;

(c) a liquid receiving chamber supported at the rear end of said body and having a portion extending outwardly from said body, said portion being representative of an udder to said animal and being flexible and manually squeezable to discharge liquid from said chamber through an openable aperture therein, said chamber being openable to provide access to the interior thereof and reclosable to provide a liquid holding chamber;

(d) an inlet tube extending from said mouth opening to said chamber for introducing liquid into said chamber;

(e) pumping means operatively connected to said chamber for pumping liquid through said mouth opening and inlet tube into said chamber;

(f) and a body of white colored dye or pigment to be disposed within the chamber to color water or other liquid introduced into the chamber a white color simulating the appearance of milk.

19. A liquid drinking and discharging toy animal apparatus, said apparatus comprising:

(a) a body having front and rear ends and a shape and design to characterize an animal;

(b) a head mounted at the front end of said body and having a mouth opening for the intake of a liquid;

(c) a liquid receiving chamber supported at the rear end of said body and having a portion extending outwardly from said body, said portion being representative of an udder of said animal and being flexible and manually squeezable to discharge liquid from said chamber through an openable aperture therein;

(d) an inlet tube extending from said mouth opening to said chamber for introducing liquid into said chamber;

(e) and separate pumping means operatively connected to said chamber and having an actuator member movably mounted on said body and having a portion located externally of said body, said portion externally of said body being manually movable relative to said body independently of movement of said body from externally of said body for pumping liquid through said mouth opening and inlet tube into said chamber.

* * * * *